US009657427B2

(12) United States Patent
Jung

(10) Patent No.: US 9,657,427 B2
(45) **Date of Patent: *May 23, 2017**

(54) WASHING MACHINE

(71) Applicant: SAMSUNG ELECTRONICS CO., LTD., Suwon-si, Gyeonggi-do (KR)

(72) Inventor: Min Young Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/747,447

(22) Filed: Jun. 23, 2015

(65) Prior Publication Data

US 2015/0284896 A1 Oct. 8, 2015

Related U.S. Application Data

(63) Continuation of application No. 13/306,184, filed on Nov. 29, 2011, now Pat. No. 9,121,129.

(30) Foreign Application Priority Data

Dec. 20, 2010 (KR) ..... 10-2010-0130844

(51) Int. Cl.

| | |
|---|---|
| ***D06F 25/00*** | (2006.01) |
| ***D06F 37/26*** | (2006.01) |
| ***D06F 58/04*** | (2006.01) |

(52) U.S. Cl.

CPC ..... *D06F 37/265* (2013.01); *D06F 25/00* (2013.01); *D06F 58/04* (2013.01)

(58) Field of Classification Search

CPC ..... D06F 25/00

See application file for complete search history.

(56) References Cited

U.S. PATENT DOCUMENTS

2005/0229650 A1 10/2005 Kim et al.

FOREIGN PATENT DOCUMENTS

| | | |
|---|---|---|
| DE | 198 00 809 A1 | 1/1999 |
| EP | 0 969 134 A1 | 1/2000 |
| EP | 1 918 445 A1 | 5/2008 |
| EP | 2 336 414 A1 | 6/2011 |
| KR | 10-2000-0007274 | 2/2000 |
| KR | 10-2006-001241 | 1/2006 |

(Continued)

OTHER PUBLICATIONS

U.S. Notice of Allowance mailed Jul. 14, 2015 in related U.S. Appl. No. 13/306,184.

(Continued)

*Primary Examiner* — Jason Ko
(74) *Attorney, Agent, or Firm* — Staas & Halsey LLP

(57) ABSTRACT

A washing machine comprises a main body, a tub provided within the main body and a balance weight mounted on the tub so as to reduce vibration of the tub. The balance weight includes a first weight member, a second and third weight members connected to both sides of the first weight member, respectively. A washing machine comprises a main body, a tub provided within the main body and a balance weight mounted at a position above a front surface opening of the tub. The balance weight includes a first weight member, a second and a third weight members connected to both sides of the first weight member. The first weight member is formed of metal and the second weight member and the third weight member are formed of concrete.

12 Claims, 7 Drawing Sheets

(56) References Cited

FOREIGN PATENT DOCUMENTS

| | | |
|---|---|---|
| KR | 10-2006-0089785 | 8/2006 |
| KR | 10-2007-0067388 | 6/2007 |

OTHER PUBLICATIONS

U.S. Appl. No. 13/306,184, filed Nov. 29, 2011, Min Young Jung, Samsung Electronics Co., Ltd.
European Search Report dated Apr. 2, 2012 in corresponding European Patent Application 11192126.8.
U.S. Office Action issued Mar. 24, 2015 in related U.S. Appl. No. 13/306,184.
Korean Office Action dated Jul. 27, 2016 in corresponding Korean Patent Application No. 10-2010-0130844.
Korean Patent Office Action issued in Korean Patent Application No. 10-2010-0130844 dated Feb. 27, 2017 (Total of 12 pages).

WASHING MACHINE

CROSS-REFERENCE TO RELATED APPLICATIONS

This application is a continuation of U.S. application Ser. No. 13/306,184 filed Nov. 29, 2011, which claims the priority benefit of Korean Patent Application No. 2010-0130844, filed on Dec. 20, 2010 in the Korean Intellectual Property Office, the disclosure of which is incorporated herein by reference.

BACKGROUND

1. Field

Embodiments relate to a washing machine having a balance weight mounted on a tub.

2. Description of the Related Art

In general, a washing machine includes a drum to receive laundry, for example, such as clothes, and a motor to rotate the drum, and performs a series of cycles, for example, such as washing, rinsing and spin-drying cycles, using rotation of the drum.

When laundry is spin-dried, the drum of the washing machine is rotated at high velocity. When centrifugal force is applied to the laundry within the drum, water contained in the laundry is centrifugally separated from the laundry.

When the drum is rotated at high velocity, serious vibration and noise are generated due to eccentricity of the laundry. In order to reduce such vibration and noise, a balance weight is generally mounted on a tub.

The balance weight is generally formed of concrete. Since the balance weight is formed in an integral type, the balance weight mounted on a specific tub may not be mounted on another tub having a different size or coupling position.

Further, in case of a washing machine provided with a drying duct, a space in which the drying duct is mounted and a space in which the balance weight is mounted may overlap each other.

SUMMARY

Therefore, it is an aspect to provide a washing machine having a balance weight mounted on a tub.

Additional aspects of the invention will be set forth in part in the description which follows and, in part, will be apparent from the description, or may be learned by practice of the invention.

In accordance with one aspect, a washing machine includes a main body, a tub provided within the main body, a drying duct connected to the tub so as to supply low-humidity air to the tub, and a balance weight mounted on the tub so as to reduce vibration of the tub, wherein the balance weight includes a first weight member and a second weight member separably connected to the first weight member, and the first weight member includes a connection part provided at one end thereof such that the second weight member is connected to the connection part, and a space formation part having a smaller thickness in the axial direction of the tub than a thickness of the second weight member so as to form a space in which the drying duct is disposed.

Impact resistance of the first weight member may be higher than impact resistance of the second weight member.

Specific gravity of the first weight member may be higher than specific gravity of the second weight member.

The second weight member may be formed of concrete.

The first weight member may be formed of metal.

The balance weight may further include a third weight member separably connected to the first weight member, and the second weight member and the third weight member may be respectively disposed at left and right sides of the first weight member.

The second weight member and the third weight member may be formed of same material.

A front space may be formed in front of the space formation part between a plane including the front surface of the space formation part and a plane including the front surface of the second weight member.

A height of the space formation part may be smaller than a height of the connection part so as to form an upper space above the space formation part.

The second weight member may be provided with a connection groove to which the connection part of the first weight member is connected.

A depth of the connection groove may correspond to a thickness of the first weight member in the forward and backward direction.

The rear surface of the first weight member and the rear surface of the second weight member may be connected without a stepped structure.

The drying duct may be disposed above the first weight member adjacent to the first weight member.

The drying duct may occupy at least a part of the front space.

The balance weight may be mounted around a front surface opening of the tub.

In accordance with another aspect, a washing machine includes a main body, a tub provided within the main body, and a balance weight mounted on the tub so as to reduce vibration of the tub, wherein the balance weight is formed by connecting a plurality of weight members.

The plurality of weight members may include a first weight member, and a second weight member and a third weight member separably connected to both sides of the first weight member.

Impact resistance of the first weight member may be higher than impact resistance of the second weight member.

Specific gravity of the first weight member may be higher than specific gravity of the second weight member.

The first weight member may be formed of metal and the second weight member and the third weight member may be formed of concrete.

The washing machine may further include a drying duct connected to the tub so as to supply low-humidity air to the tub, the first weight member may include a connection part provided at one end thereof such that the second weight member is connected to the connection part and a space formation part having a smaller thickness in the axial direction of the tub than a thickness of the second weight member so as to form a space in which the drying duct is disposed, and a front space may be formed in front of the space formation part by a thickness difference between the second weight member and the space formation part.

A height of the space formation part may be smaller than a height of the connection part so as to form an upper space above the space formation part.

The rear surface of the first weight member and the rear surface of the second weight member may be connected without a stepped structure.

The drying duct may occupy at least a part of the front space and at least a part of the upper space.

The balance weight may be mounted at a position above a front surface opening of the tub.

In accordance with a further aspect, a washing machine includes a main body, a tub provided within the main body, and a balance weight mounted at a position above a front surface opening of the tub, wherein the balance weight includes a first weight member and a second weight member and a third weight member separably connected to both sides of the first weight member, the first weight member is formed of metal, and the second weight member and the third weight member are formed of concrete.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
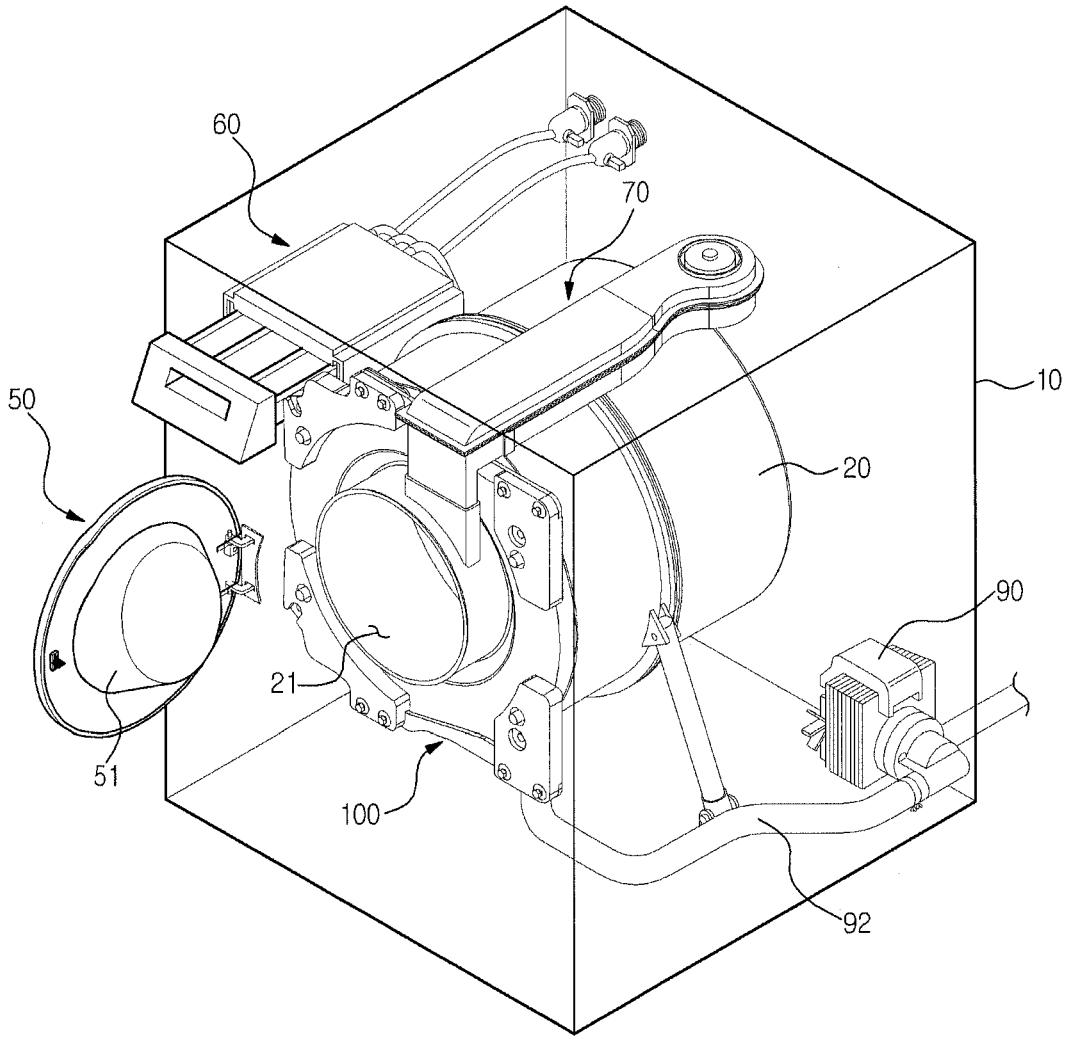
FIG. 1 is a perspective view of a washing machine in accordance with one embodiment.

Reference will now be made in detail to the embodiments, examples of which are illustrated in the accompanying drawings, wherein like reference numerals refer to like elements throughout.

Figure 2:
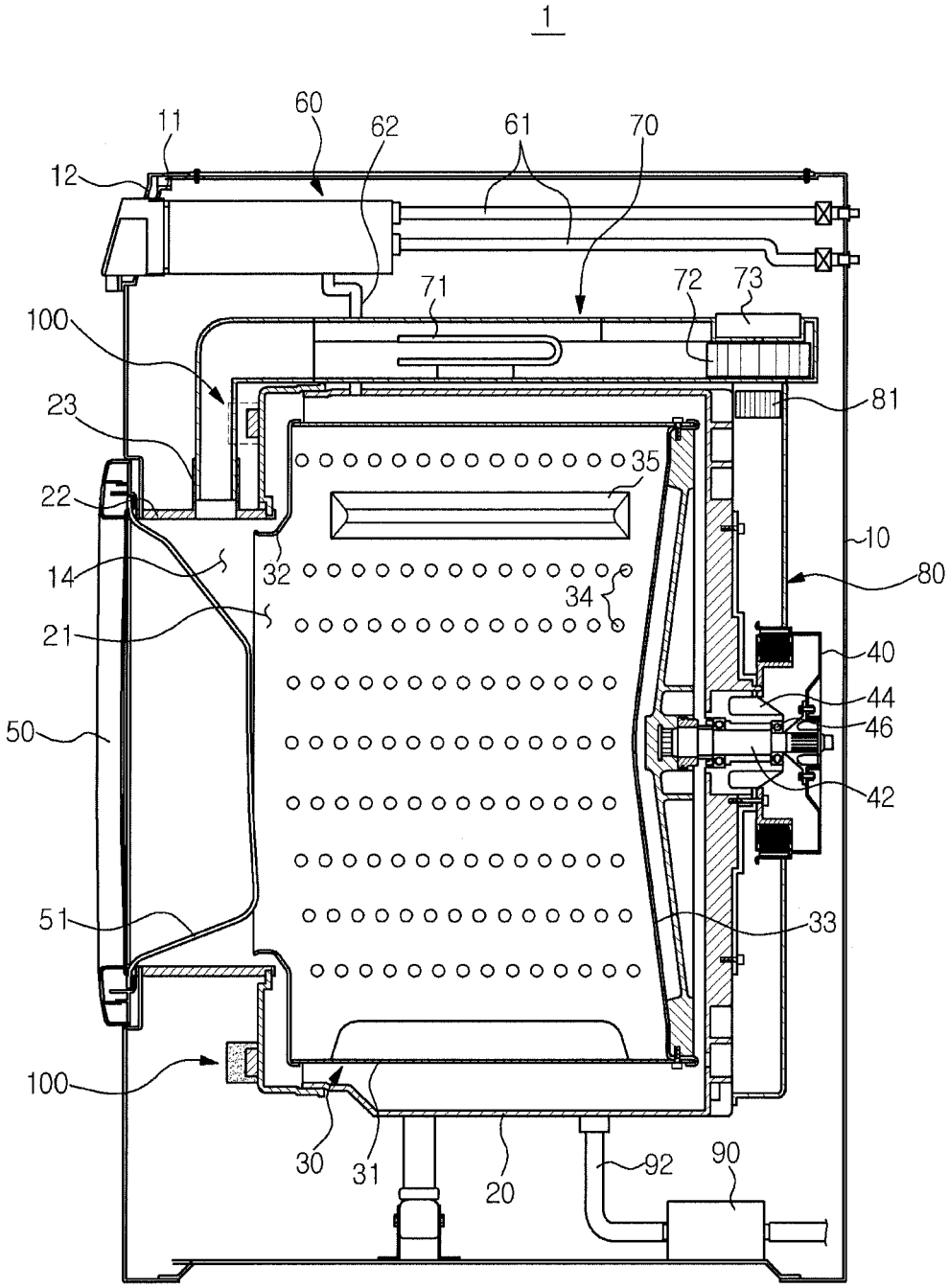
FIG. 2 is a cross-sectional view illustrating main components of the washing machine in accordance with the embodiment.

FIG. 1 is a perspective view of a washing machine in accordance with one embodiment and FIG. 2 is a cross-sectional view illustrating main components of the washing machine in accordance with the embodiment.

As shown in FIGS. 1 and 2, a washing machine 1 in accordance with this embodiment includes a main body 10 forming the external appearance of the washing machine 1, a tub 20 disposed within the main body 10, a drum 30 rotatably disposed within the tub 20, and a motor 40 to drive the drum 30.

An inlet 14 through which laundry is put into the drum 30 is formed through the front surface portion of the main body 10, and is opened and closed by a door 50 installed on the front surface portion of the main body 10. Further, a door glass 51 formed of a transparent material is mounted along the inner circumferential surface of the door 50 such that a user may view the interior of the drum 30 with the naked eye.

An opening 21 is formed on the front surface portion of the tub 20 at a position corresponding to the inlet 14 of the main body 10. In order to shield a space between the inlet 14 of the main body 10 and the opening 21 of the tub 20, a gasket 22 connecting the inlet 14 and the opening 21 is installed. The gasket 22 is fixed to the main body 10 and the tub 20, respectively. The gasket 22 may be formed of an elastic material so as to cope with vibration of the tub 20.

Water supply hoses 61 to supply wash water to the tub 20 are installed above the tub 20. The water supply hoses 61 are connected to an external water supply source (not shown) and a detergent supply device 60.

The detergent supply device 60 is connected to the tub 20 through a connection hose 62. Water supplied through the water supply hoses 61 is supplied to the detergent supply device 60 and is mixed with detergents in the detergent supply device 60. Then, water containing the detergents is supplied to the inside of the tub 20.

A drain pump 90 and a drain pipe 92 to discharge the water in the tub 20 to the outside of the main body 10 are installed under the tub 20.

The drum 30 includes a cylindrical member 31, a front plate 32 disposed at the front part of the cylindrical member 31, and a rear plate 33 disposed at the rear part of the cylindrical member 31. An opening 36 through which the laundry is put into the drum 30 is formed on the front plate 32, and a drive shaft 42 to transmit power of the motor 40 is connected to the rear plate 33.

A bearing housing 44 is installed on the rear wall of the tub 20 so as to rotatably support the drive shaft 42. The bearing housing 44 is formed of an aluminum alloy and is inserted into the rear wall of the tub 20 when the tub 20 is formed through injection molding. Bearings 46 are installed between the bearing housing 44 and the drive shaft 42 so as to efficiently rotate the drive shaft 42.

The drive shaft 42 is disposed between the drum 30 and the motor 40. One end of the drive shaft 42 is connected to the rear plate 33 of the drum 30, and the other end of the drive shaft 42 is extended to the outside of the rear wall of the tub 20. When the motor 40 drives the drive shaft 42, the drum 30 connected to the drive shaft 42 is rotated around the drive shaft 42.

A plurality of through holes 34 to circulate wash water is formed through the circumferential surface of the drum 30, and a plurality of lifters 35 to tumble laundry during rotation of the drum 30 is installed on the inner circumferential surface of the drum 30.

A drying duct 70 to supply high-temperature and low-humidity air to the laundry in the drum 30 is installed on the tub 20, and a condensation duct 80, to collect high-temperature and high-humidity air having passed through the laundry, to convert the high-temperature and high-humidity air into low-temperature and low-humidity air, and then to circulate the low-temperature and low-humidity air to the drying duct 70, is installed in the rear of the tub 20. The drying duct 70 includes a heater 71, a fan 72, and a fan motor 73 so as to blow high-temperature and low-humidity air to the inside of the tub 20, and the condensation duct 80 includes a cooling device 81 to convert high-temperature and high-humidity air into low-temperature and low-humidity air. The cooling device 81 supplies cooling water to the condensation duct 80, thereby converting the high-temperature and high-humidity air into the low-temperature and low-humidity air. A discharge hole of the drying duct 70 is connected to a connection hole 23 formed on the gasket 22.

During the washing and rinsing cycles, the motor 40 rotates the drum 30 at low velocity in regular and reverse directions. As the laundry in the drum 30 is repeatedly tumbled due to rotation of the drum 30, contaminants are removed from the laundry. Further, during the spin-drying cycle, the motor 40 rotates the drum 30 at high velocity in one direction, thereby removing water from the laundry using centrifugal force applied to the laundry. When the drum 30 is rotated at high velocity, vibration is generated by the drum 30 due to eccentricity of the laundry and is transmitted to the tub 20. Then, vibration and noise are generated by the tub 20.

Therefore, the washing machine 1 includes balance weights 100 to reduce vibration and noise generated by the tub 20 when the drum 30 is rotated at high velocity.

Figure 3:
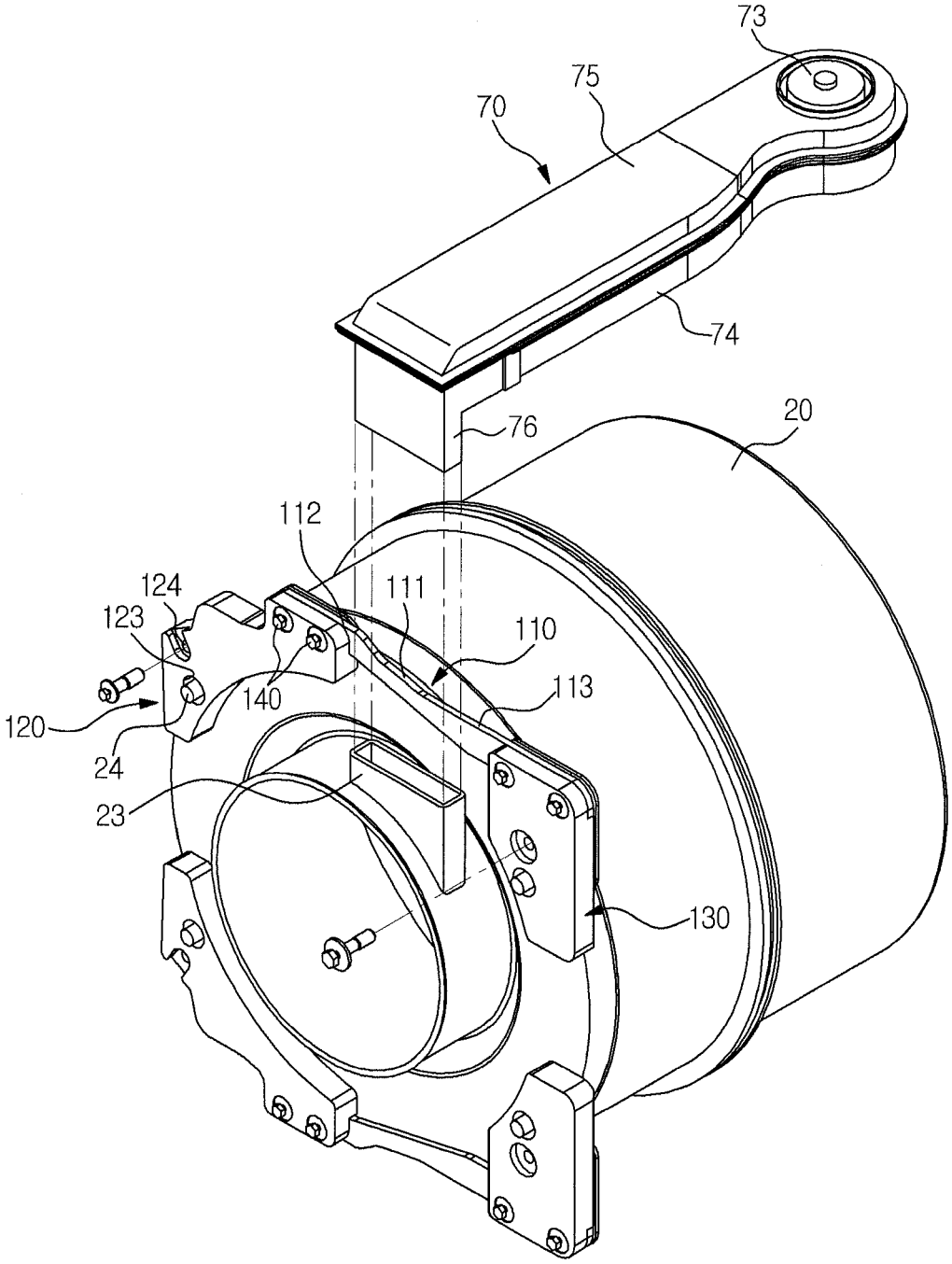
FIG. 3 is a perspective view of a tub on which balance weights in accordance with the embodiment are mounted.
Figure 4:
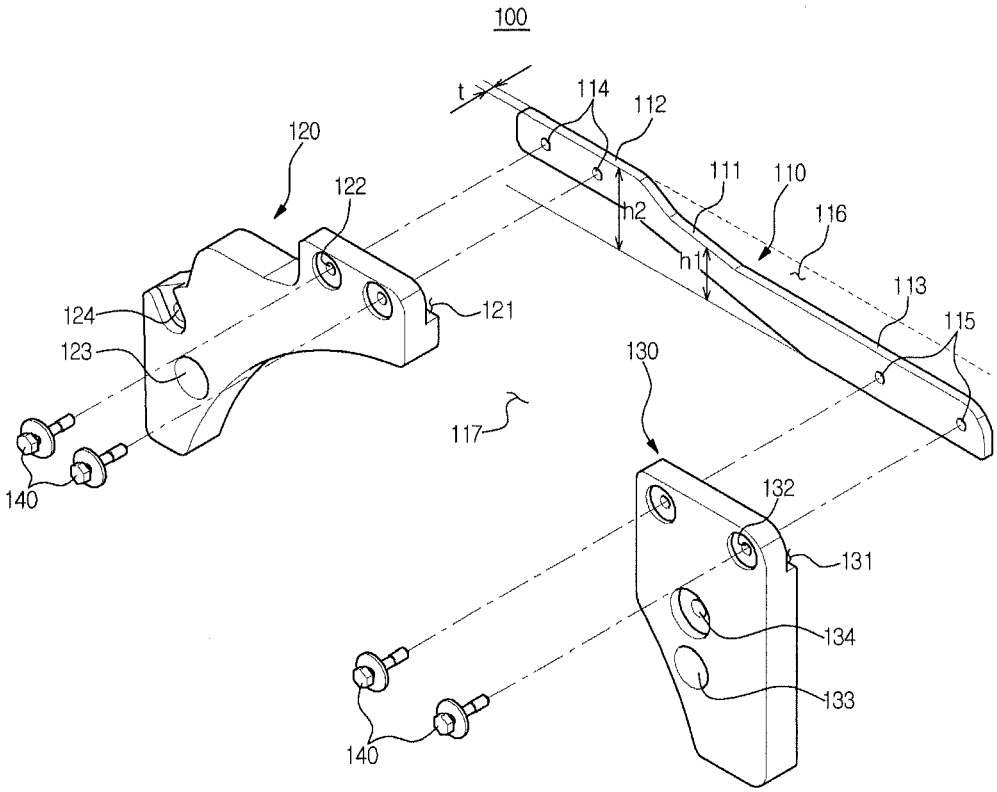
FIG. 4 is an exploded perspective view of the balance weight in accordance with the embodiment.
Figure 5:
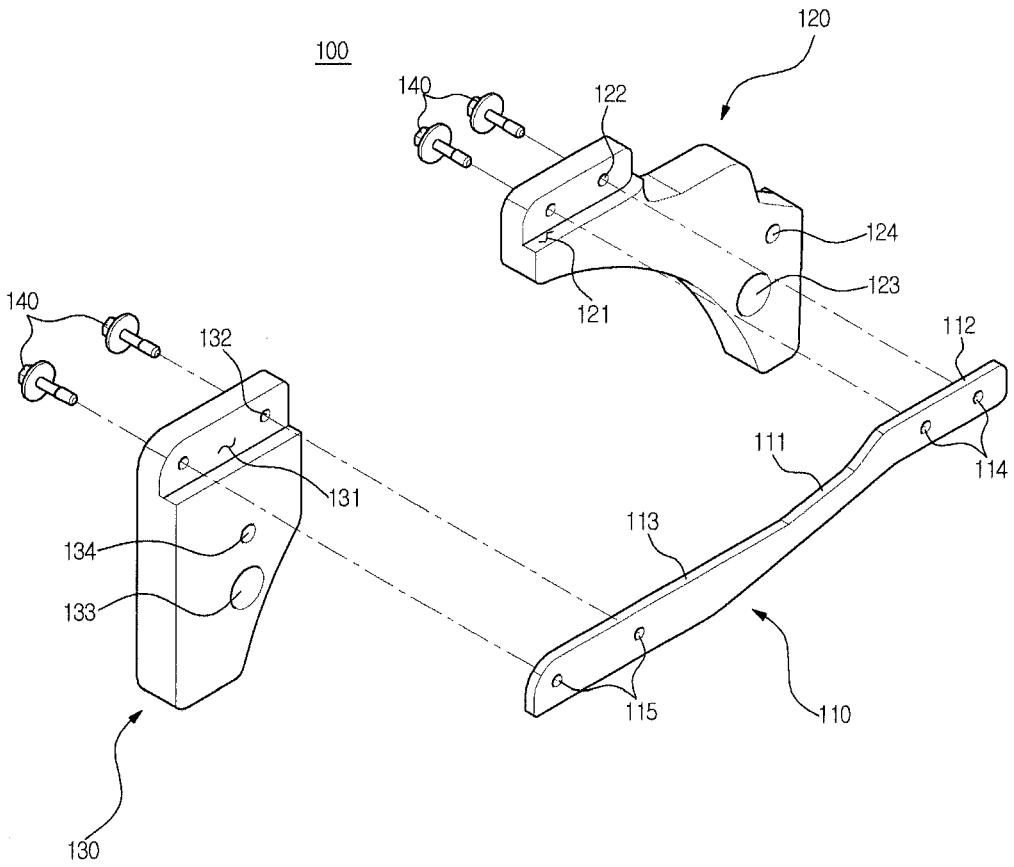
FIG. 5 is an exploded perspective view of the balance weight in accordance with the embodiment, seen from a different angle.
Figure 6:
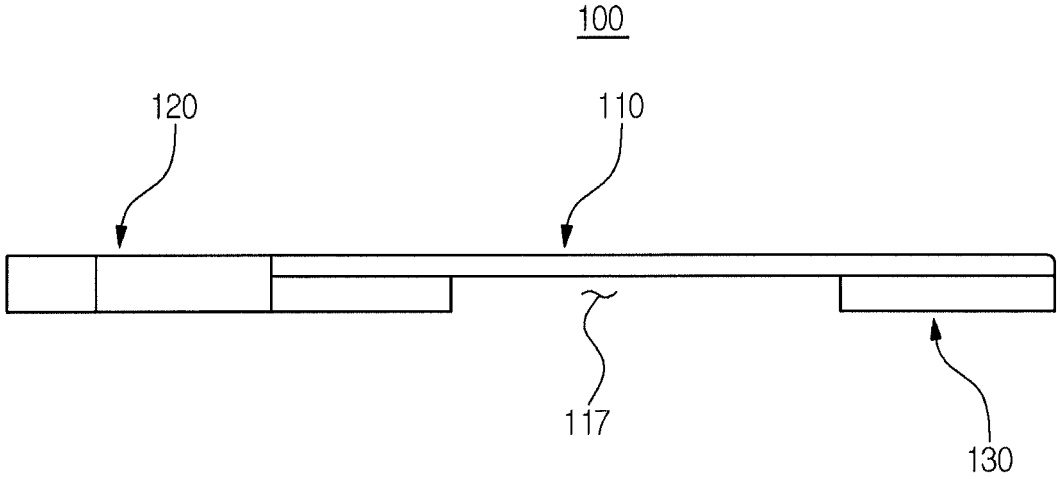
FIG. 6 is a side view of the balance weight in accordance with the embodiment.

FIG. 3 is a perspective view of the tub on which the balance weights in accordance with the embodiment are mounted, FIG. 4 is an exploded perspective view of the balance weight in accordance with the embodiment, FIG. 5 is an exploded perspective view of the balance weight in accordance with the embodiment, seen from a different angle, and FIG. 6 is a side view of the balance weight in accordance with the embodiment.

As shown in FIGS. 3 to 6, the balance weight 100 is disposed at each of positions above and below the front surface opening of the tub 20. Further, the drying duct 70 is disposed on the tub 20. Hereinafter, the balance weight 100 disposed at the position above the front surface opening of the tub 20 will be exemplarily described.

The balance weight 100 includes a first weight member 110, and a second weight member 120 and a third weight member 130 separably connected to both sides of the first weight member 110.

The first weight member 110 has a bar shape. The first weight member 110 includes connection parts 112 and 113 to which the second weight member 120 and the third weight member 130 are connected, and a space formation part 111 connected to the connection units 112 and 113. The connection parts 112 and 113 include a first connection part 112 to which the second weight member 120 is connected and a second connection part 113 to which the third weight member 130 is connected, and the space formation part 111 is disposed between the first connection part 112 and the second connection part 113. The connection parts 112 and 113 and the space formation part 111 may be formed integrally.

The second weight member 120 and the third weight member 130 may be manufactured separately from the first weight member 110, and then separably connected to the first weight member 110. The second weight member 120 and the third weight member 130 are disposed at the left and right sides of the first weight member 110.

The first connection part 112 of the first weight member 110 and the second weight member 120 are respectively provided with coupling holes 114 and 122, thus being connected using coupling bolts 140. In the same manner, the second connection part 113 of the first weight member 110 and the third weight member 130 are respectively provided with coupling holes 115 and 132, thus being connected using coupling bolts 140.

Connection grooves 121 and 131 having a shape corresponding to the connection parts 112 and 113 of the first weight member 110, respectively, so that the connection parts 112 and 113 are connected to the connection grooves 121 and 131, and are formed on the rear surfaces of the second weight member 120 and the third weight member 130, respectively. A depth of the connection grooves 121 and 131 corresponds to a thickness t of the connection parts 112 and 113 in the forward and backward direction. Therefore, the second weight member 120 and the third weight member 130 are connected to the first weight member 110 without a stepped structure between the rear surface of the first weight member 110 and the rear surface of the second weight member 120 and between the rear surface of the first weight member 110 and the rear surface of the third weight member 130. The forward and backward direction of the first weight member 110 corresponds to the axial direction of the tub 20.

The balance weight 100 may be mounted on the tub 20 under the condition that the second weight member 120 and the third weight member 130 are connected to the first weight member 110. Positioning protrusions 24 to set a mounting position of the balance weight 100 are provided on the front surface of the tub 20, and positioning holes 123 and 133 into which the positioning protrusions 24 are inserted are provided on the second weight member 120 and the third weight member 130, respectively. Further, mounting holes 124 and 134 are provided on the second weight member 120, and the third weight member 130, respectively. The balance weight 100 may be mounted on the tub 20 by coupling the mounting holes 124 and 134 with coupling bolts 140 under the condition that the positioning protrusions 24 of the tub 20 are inserted into the positioning holes 123 and 133.

The first weight member 110 is formed of metal. Further, the first weight member 110 may be a cast metal product. Various metals may be used to manufacture the first weight member 110. Since the first weight member 110 needs to have a weight member of more than a designated value so as to reduce vibration of the tub 20, metal used to manufacture the first weight member 110 may have a specific gravity of 7 to 8. However, the specific gravity of the metal used to manufacture the first weight member 110 is not limited thereto and various metals may be selected in consideration of manufacturing costs and a weight member required by the balance weight 100.

The second weight member 120 is formed of concrete. The second weight member 120 may be formed of concrete used to manufacture general balance weights. Further, the third weight member 130 may be formed of the same material as the second weight member 120.

Since the first weight member 110 is formed of metal, impact resistance of the first weight member 110 may be higher than impact resistance of the second weight member 120 formed of concrete. Therefore, although the first weight member 110 has a smaller thickness than the second weight member 120, damage to the first weight member 110 due to vibration generated during operation of the washing machine may be prevented.

The connection parts 112 and 113 and the space formation part 111 of the first weight member 110 may have the same thickness t. Since the thickness of the space formation part 111 is smaller than the thickness of the second weight member 120 and the first weight member 110 is connected to the rear portion of the second weight member 120, a front space 117 is formed in front of the space formation part 111. That is, since a plane including the front surface of the second weight member 120 and a plane including the front surface of the space formation part 111 are separated from each other by a designated interval, the front space 117 is provided between the two planes.

A height h2 of the first connection part 112 is greater than a height h1 of the space formation part 111. Therefore, an upper space 116 defined by a difference between the two heights h1 and h2 is provided above the space formation part 111. Compared with the entirety of a balance weight having the same thickness as that of the second weight member 120, the balance weight 100 in accordance with this embodiment includes the first weight member 110 having higher specific gravity and impact resistance, thereby being capable of forming the front space 117 and the front space 116.

The drying duct 70 includes a lower housing 74 provided with an opened upper portion and disposed on the tub 20, and an upper housing 75 provided with an opened lower portion and connected to the lower housing 74 so as to form a space through which air flows. The heater 71 and the fan 72 shown in FIG. 2 are disposed in the space formed by the upper housing 75 and the lower housing 74.

Further, the drying duct 70 includes a connection housing 76 formed at the end of the lower housing 74 and connected to the connection hole 23 communicated with the inside of the tub 20. The connection housing 76 is bent downwards from the top of the front surface of the tub 20 and is connected to the connection hole 23 disposed on the front surface of the tub 20 so as to supply high-temperature and low-humidity air to the inside of the tub 20.

Figure 7:
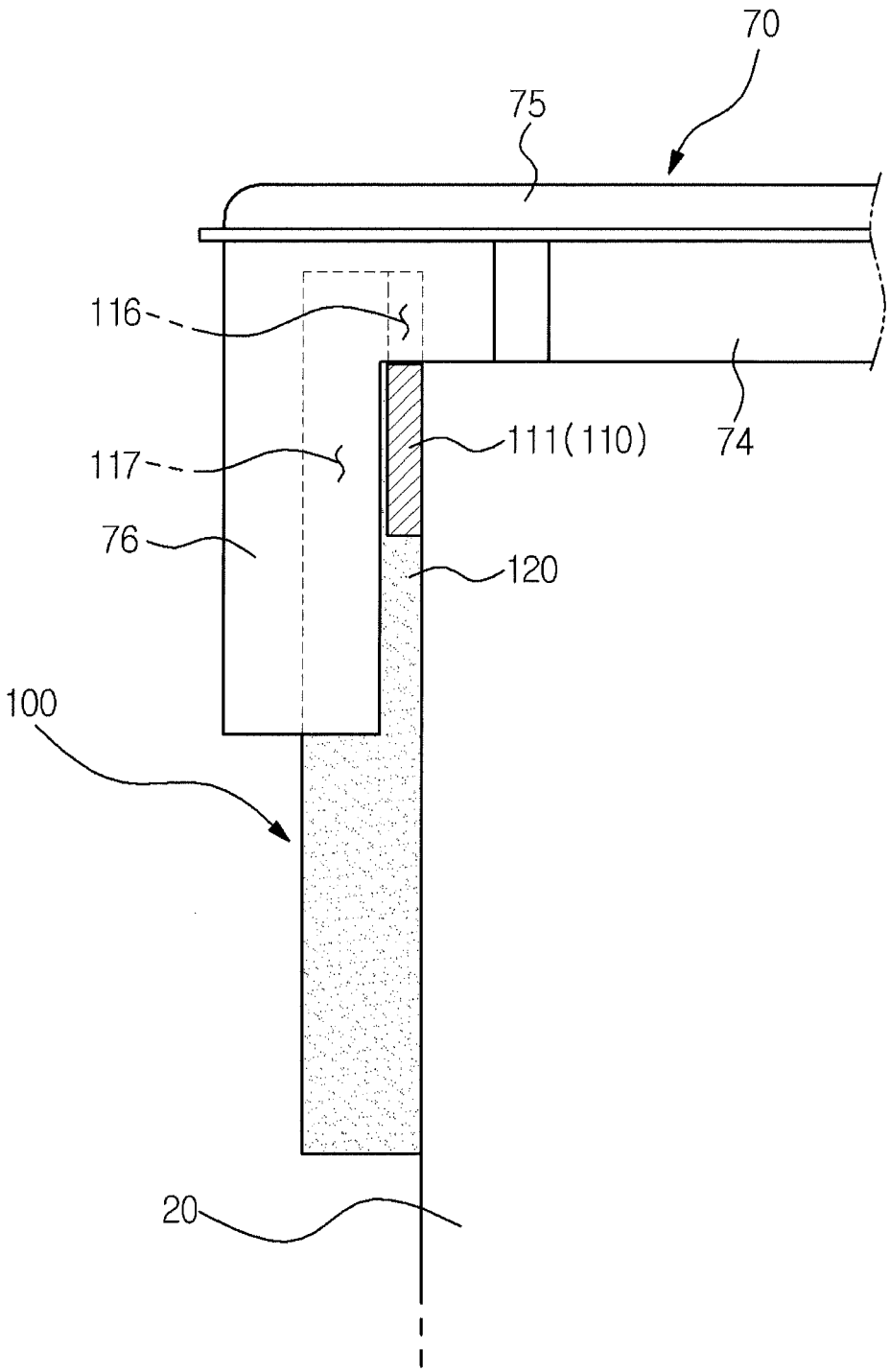
FIG. 7 is a view illustrating position relations between the balance weight and a drying duct of the washing machine in accordance with the embodiment.

FIG. 7 is a view illustrating position relations between the balance weight and the drying duct of the washing machine in accordance with the embodiment.

As shown in FIG. 7, the drying duct 70 is disposed adjacent to the balance weight 100. Since the connection housing 76 of the drying duct 70 is bent downwards from the top of the front surface of the tub 20 and the balance weight 100 is mounted at the position above the front surface opening of the tub 20, a space in which the connection housing 76 is disposed and a space in which the balance weight 100 is mounted may overlap each other.

In order to assure the space in which the connection housing 76 is disposed, a thickness of a portion of the balance weight 100 adjacent to the connection housing 76 needs to be reduced. However, if the balance weight 100 is formed of generally used concrete to a thin thickness, impact resistance of the balance weight 100 is lowered due to material characteristics of the balance weight 100. Further, if the entirety of the balance weight 100 is formed of a cast metal product, the balance weight 100 may satisfy a required level of impact resistance even with a thin thickness but manufacturing costs of the balance weight 100 are increased.

The balance weight 100 in accordance with the embodiment is configured such that a plurality of weight members is separably connected. Further, since the first weight member 110 is formed of a material having higher specific gravity and impact resistance than the second weight member 120, the thickness of the space formation part 111 of the first weight member 110 in the forward and backward direction may be smaller than the thickness of the second weight member 120 in the forward and backward direction and an extra space may be provided above the space formation part 111. That is, the upper space 116 and the front space 117 may be provided above and in front of the space formation part 111.

The connection housing 76 of the drying duct 70 is disposed so as to occupy at least a part of the upper space 116 and at least a part of the front space 117 formed by the space formation part 111 of the first weight member 110. Therefore, the drying duct 70 may be disposed closer to the tub 20 without spatial interference with the balance weight 100.

During operation of the washing machine, the balance weight may be damaged due to vibration. If the balance weight is formed in an integral type, the entirety of the balance weight needs to be replaced with a new one regardless of a damaged region. However, the balance weight 100 in accordance with the embodiment allows only a damaged weight member to be replaced, thereby improving ease of maintenance. For example, when the second weight member 120 is damaged, the second weight member 120 is separated from the balance weight 100 and is then replaced with a new one, thus being easily repaired.

Further, the size of the tub is varied according to a washing capacity of the washing machine. If the balance weight is formed in the integral type, balance weights having various sizes need to be manufactured so as to be mounted on tubs having various sizes. However, the balance weight 100 in accordance with the embodiment includes a plurality of separably connected weight members, and may thus be mounted on tubs having various sizes by changing shapes of some of the weight members. Further, in the tub having the same size, a mounting position of the balance weight may be changed. In this case, the balance weight 100 in accordance with the embodiment may be mounted on the tub by changing shapes of some of the weight members.

Although this embodiment illustrates the balance weight 100 as including three members, the first weight member 110 and the second weight member 120 may be formed integrally or the first weight member 110 and the third weight member 130 may be formed integrally. Here, the first weight member 110 may be formed in various shapes in consideration of weight member balance and include the space formation part 111 so as to avoid spatial interference with the drying duct 70.

As is apparent from the above description, a balance weight of a washing machine in accordance with one embodiment includes a plurality of connected weight members, and may thus be mounted on tubs having various sizes and shapes by replacing some of the weight members. Further, when a weight member is damaged during operation of the washing machine, only the damaged weight member needs to be replaced without replacement of the entirety of the balance weight, thereby increasing ease of maintenance of the washing machine.

In case of a washing machine provided with a drying duct, a space in which the drying duct is disposed and a space in which the balance weight is disposed may overlap each other. In this case, when a weight member adjacent to the drying duct out of the plurality of weight members is formed of a material having high impact resistance, the weight member may have a thin thickness and thus the space in which the drying duct is disposed may be ensured.

Further, the balance weight may satisfy required impact resistance while reducing manufacturing costs compared with a balance weight integrally formed of metal.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a main body;

a tub provided within the main body;

a drying duct configured to supply air to the tub; and a balance weight mounted on the tub so as to reduce vibration of the tub, the balance weight including a first weight member including a body part and mounting portions on both ends of the body part, and a second weight member and a third weight member mounted to the mounting portions of the first weight member, respectively, to form the balance weight, wherein the balance weight is mounted to the tub by mounting the second weight member and the third weight member to the tub so that the first weight member is disposed in front of a front surface of the tub, and wherein the drying duct is disposed above the body part of the first weight member and between the second weight member and the third weight member.

2. The washing machine according to claim 1, wherein impact resistance of the first weight member is higher than impact resistance of the second weight member.

3. The washing machine according to claim 1, wherein specific gravity of the first weight member is higher than specific gravity of the second weight member.

4. The washing machine according to claim 1, wherein:

the first weight member is formed of metal; and the second weight member and the third weight member are formed of concrete.

5. The washing machine according to claim 1, wherein the body part has a smaller thickness in an axial direction of the tub than at least one of a thickness of the second weight member and a thickness of the third weight member so as to form a space in which the drying duct is disposed.

6. The washing machine according to claim 5, wherein a height of the body part is smaller than heights of the mounting portions so as to form an upper space above the body part.

7. The washing machine according to claim 1, wherein a rear surface of the first weight member and a rear surface of the second weight member are connected and a portion of the first weight member, the second weight member and third weight members are not substantially protruded out when the first and second weight members are connected.

8. The washing machine according to claim 5, wherein the drying duct occupies at least a part of the front space and at least a part of the upper space.

9. The washing machine according to claim 1, wherein the balance weight is mounted at a position above a front surface opening of the tub.

10. The washing machine according to claim 5, wherein a front space is formed in front of the body part by a thickness difference between the second weight member and the body part.

11. The washing machine according to claim 1, wherein the second weight member and the third weight member have an accommodation portion, respectively, to accommodate the mounting portions of the first weight member.

12. The washing machine according to claim 1, wherein thicknesses of the accommodation portions of the second weight member and the third weight member correspond to a thickness of the first weight member to form a space where the drying duct is disposed.

* * * * *